US009530434B1

(12) United States Patent
Mascaro et al.

(10) Patent No.: US 9,530,434 B1
(45) Date of Patent: Dec. 27, 2016

(54) REDUCING OCTAVE ERRORS DURING PITCH DETERMINATION FOR NOISY AUDIO SIGNALS

(71) Applicant: THE INTELLISIS CORPORATION, San Diego, CA (US)

(72) Inventors: Massimo Mascaro, San Diego, CA (US); David C. Bradley, La Jolla, CA (US)

(73) Assignee: KnuEdge Incorporated, San Diego, CA (US)

( * ) Notice: Subject to any disclaimer, the term of this patent is extended or adjusted under 35 U.S.C. 154(b) by 0 days.

(21) Appl. No.: 13/945,731

(22) Filed: Jul. 18, 2013

(51) Int. Cl.
*G10L 25/90* (2013.01)

(52) U.S. Cl.
CPC ..... *G10L 25/90* (2013.01)

(58) Field of Classification Search
CPC ..... G10L 2025/903; G10L 2025/906
See application file for complete search history.

(56) References Cited

U.S. PATENT DOCUMENTS

| | | | | |
|---|---|---|---|---|
| 5,774,837 | A | 6/1998 | Yeldener et al. | |
| 5,815,580 | A | 9/1998 | Craven et al. | 381/58 |
| 5,978,824 | A | 11/1999 | Ikeda | |
| 6,195,632 | B1 * | 2/2001 | Pearson | G10L 13/04 704/206 |
| 6,594,585 | B1 * | 7/2003 | Gersztenkorn | 702/14 |
| 7,085,721 | B1 | 8/2006 | Kawahara | |
| 7,117,149 | B1 | 10/2006 | Zakarauskas | 704/233 |
| 7,249,015 | B2 | 7/2007 | Jiang et al. | 704/222 |
| 7,389,230 | B1 | 6/2008 | Nelken | 704/255 |
| 7,664,640 | B2 | 2/2010 | Webber | 704/243 |
| 7,668,711 | B2 | 2/2010 | Chong et al. | 704/219 |
| 8,015,002 | B2 | 9/2011 | Li et al. | |
| 8,380,331 | B1 * | 2/2013 | Smaragdis | G10L 25/90 700/94 |
| 2003/0177002 | A1 | 9/2003 | Chen | |

(Continued)

FOREIGN PATENT DOCUMENTS

| | | |
|---|---|---|
| WO | WO 2012/129255 | 9/2012 |
| WO | WO 2012/134991 | 10/2012 |
| WO | WO 2012/134993 | 10/2012 |

OTHER PUBLICATIONS

S. Saha and S. M. Kay, "Maximum likelihood parameter estimation of superimposed chirps using Monte Carlo importance sampling," in IEEE Transactions on Signal Processing, vol. 50, No. 2, pp. 224-230, Feb. 2002.*

(Continued)

*Primary Examiner* — Michael N Opsasnick
*Assistant Examiner* — Kee Young Lee
(74) *Attorney, Agent, or Firm* — Edell, Shapiro & Finnan, LLC

(57) ABSTRACT

Octave errors may be reduced during pitch determination for noisy audio signals. Pitch may be tracked over time by determining amplitudes at harmonics for individual time windows of an input signal. Octave errors may be reduced in individual time windows by fitting amplitudes of corresponding harmonics across successive time windows to identify spurious harmonics caused by octave error. A given harmonic may be identified as either being associated with the same pitch as adjacent harmonics in the given time window or being spurious based on parameters of the fitting function.

19 Claims, 4 Drawing Sheets

(56) References Cited

U.S. PATENT DOCUMENTS

| | | | | |
|---|---|---|---|---|
| 2004/0066940 | A1 | 4/2004 | Amir | |
| 2004/0111266 | A1 | 6/2004 | Coorman et al. | |
| 2004/0128130 | A1 | 7/2004 | Rose et al. | 704/236 |
| 2004/0158462 | A1* | 8/2004 | Rutledge et al. | 704/207 |
| 2004/0167777 | A1 | 8/2004 | Hetherington et al. | |
| 2004/0176949 | A1 | 9/2004 | Wenndt et al. | 704/203 |
| 2004/0220475 | A1 | 11/2004 | Szabo et al. | 600/458 |
| 2005/0114128 | A1 | 5/2005 | Hetherington et al. | 704/233 |
| 2005/0149321 | A1* | 7/2005 | Kabi et al. | 704/207 |
| 2006/0053003 | A1* | 3/2006 | Suzuki et al. | 704/216 |
| 2006/0100866 | A1 | 5/2006 | Alewine et al. | 704/226 |
| 2006/0100868 | A1 | 5/2006 | Hetherington et al. | |
| 2006/0130637 | A1 | 6/2006 | Crebouw | |
| 2006/0136203 | A1 | 6/2006 | Ichikawa | |
| 2007/0010997 | A1 | 1/2007 | Kim | 704/208 |
| 2008/0033585 | A1 | 2/2008 | Zopf | |
| 2008/0052068 | A1 | 2/2008 | Aguilar et al. | |
| 2008/0082323 | A1 | 4/2008 | Bai et al. | 704/214 |
| 2008/0234959 | A1* | 9/2008 | Joublin | G10L 25/90 702/75 |
| 2008/0262836 | A1* | 10/2008 | Goto | G10H 3/125 704/207 |
| 2008/0312913 | A1* | 12/2008 | Goto | G10G 3/04 704/207 |
| 2009/0012638 | A1 | 1/2009 | Lou | 700/94 |
| 2009/0016434 | A1 | 1/2009 | Amonou et al. | |
| 2009/0076822 | A1 | 3/2009 | Sanjaume | |
| 2010/0131086 | A1* | 5/2010 | Itoyama | G10H 1/0008 700/94 |
| 2010/0174534 | A1 | 7/2010 | Vos | |
| 2010/0211384 | A1 | 8/2010 | Qi et al. | |
| 2010/0260353 | A1 | 10/2010 | Ozawa | 381/94.3 |
| 2010/0299144 | A1* | 11/2010 | Barzelay et al. | 704/233 |
| 2010/0332222 | A1 | 12/2010 | Bai et al. | 704/214 |
| 2011/0016077 | A1 | 1/2011 | Vasilache et al. | 706/52 |
| 2011/0060564 | A1 | 3/2011 | Hoge | 703/2 |
| 2011/0286618 | A1 | 11/2011 | Vandali et al. | 381/320 |
| 2012/0010881 | A1* | 1/2012 | Avendano | G10L 21/0272 704/226 |
| 2012/0072209 | A1* | 3/2012 | Krishnan | G10L 25/90 704/207 |
| 2012/0191450 | A1* | 7/2012 | Pinson | 704/233 |
| 2012/0243694 | A1 | 9/2012 | Bradley et al. | 381/56 |
| 2012/0243705 | A1 | 9/2012 | Bradley et al. | 381/94.4 |
| 2012/0243707 | A1 | 9/2012 | Bradley et al. | 381/98 |
| 2013/0046533 | A1 | 2/2013 | Nyquist et al. | |
| 2013/0158923 | A1 | 6/2013 | Stanton et al. | |
| 2013/0165788 | A1 | 6/2013 | Osumi et al. | |
| 2013/0255473 | A1* | 10/2013 | Abe et al. | 84/605 |

OTHER PUBLICATIONS

Y. Pantazis, O. Rosec and Y. Stylianou, "Chirp rate estimation of speech based on a time-varying quasi-harmonic model," 2009 IEEE International Conference on Acoustics, Speech and Signal Processing, Taipei, 2009, pp. 3985-3988.*

Kumar et al., "Speaker Recognition Using GMM", *International Journal of Engineering Science and Technology*, vol. 2, No. 6, 2010, retrieved from the Internet: http://www.ijest.info/docs/IJEST10-02-06-112.pdf, pp. 2428-2436.

Kamath et al, "Independent Component Analysis for Audio Classification", *IEEE 11th Digital Signal Processing Workshop & IEEE Signal Processing Education Workshop*, 2004, retrieved from the Internet: http://2002.114.89.42/resource/pdf/1412.pdf, pp. 352-355.

Vargas-Rubio et al., "An Improved Spectrogram Using the Multiangle Centered Discrete Fractional Fourier Transform", *Proceedings of International Conference on Acoustics, Speech, and Signal Processing*, Philadelphia, 2005, retrieved from the internet: <URL: http://www.ece.unm.edu/faculty/beanthan/PUB/ICASSP-05-JUAN.pdf>, 4 pages.

U.S. Appl. No. 13/961,811 Office Action dated Apr. 20, 2015 citing prior art, 9 pages.

U.S. Appl. No. 13/961,811, Aug. 7, 2013, 30 pages.

Saha, S.; Kay, S.M., "Maximum likelihood parameter estimation of superimposed chirps using Monte Carlo importance sampling," in Signal Processing, IEEE Transactions on , vol. 50, No. 2, pp. 224-230, Feb. 2002.

Vargas-Rubio, J.G.; Santhanam, B., An improved spectrogram using the multiangle centered discrete fractional Fourier transform,: in Acoustics, Speech, and Signal Processing, 2005. Proceedings. (ICASSP '05). IEEE International Conference on , vol. 4, No., pp. iv/505-iv/508 vol. 4, Mar. 18-23, 2005.

Pantazis, Y.; Rosec, O.; Stylianou, Y., "Chirp rate estimation of speech based on a time-varying quasi-Harmonic-model," in Acoustics, Speech and Signal Processing, 2009. ICASSP 2009. IEEE International Conference on , vol., No., pp. 3985-3988, Apr. 19-24, 2009.

Luis Weruaga, Marian Kepesi, The fan-chirp transform for non-stationary harmonic signals, Signal Processing, vol. 87, Issue 6, Jun. 2007, pp. 1504-1522, ISSN 0165-1684, http://dx.doi.org/10.1016/j.sigpro.2007.01.006. (http://www.sciencedirect.com/science/article/pii/S0165168407000114).

* cited by examiner

REDUCING OCTAVE ERRORS DURING PITCH DETERMINATION FOR NOISY AUDIO SIGNALS

FIELD OF THE DISCLOSURE

This disclosure relates to reducing octave errors during pitch determination for noisy audio signals, such as with voice enhancement of noisy audio signals.

SUMMARY

One aspect of the disclosure relates to a system configured to perform voice enhancement on noisy audio signals, in accordance with one or more implementations. Because pitch determines harmonic spacing, any integer divider of pitch can explain a harmonic signal. Any multiple of the pitch can explain a large fraction of a signal. This may create an ambiguity in the pitch estimation producing "octave errors." As such, the system may be configured to reduce octave errors during pitch determination for such noisy audio signals. Octave errors may be reduced during pitch determination for noisy audio signals. Pitch may be tracked over time by determining amplitudes at harmonics for individual time windows of an input signal. Octave errors may be reduced in individual time windows by fitting amplitudes of corresponding harmonics across successive time windows to identify spurious harmonics caused by octave error. A given harmonics in a given time window may be associated with a fitting function that fits amplitudes of harmonics corresponding to the given harmonic in time windows proximate to the given time window. The given harmonic may be identified as either being associated with the same pitch as adjacent harmonics in the given time window or being spurious based on parameters of the fitting function.

The communications platform may be configured to execute computer program modules. The computer program modules may include one or more of an input module, a pitch tracking module, an octave error reduction module, one or more extraction modules, a reconstruction module, an output module, and/or other modules.

The input module may be configured to receive an input signal from a source. The input signal may include human speech (or some other wanted signal) and noise. The waveforms associated with the speech and noise may be superimposed in input signal.

The pitch tracking module may be configured to track pitch over time. This may include determining amplitudes at harmonics for individual time windows of the input signal. Tracked pitch in the first time window may be associated with a number of harmonics including a first harmonic and a second harmonic. The first harmonic may have a first amplitude and the second harmonic may have a second amplitude. The first harmonic and the second harmonic may be adjacent but either associated with the same pitch or different pitches resulting from an octave error. An octave error in the pitch may determine whether harmonics correspond to the actual signal or are spurious.

Generally speaking, the extraction module(s) may be configured to extract harmonic information from the input signal. The extraction module(s) may include one or more of a transform module, a formant model module, and/or other modules.

The transform module may be configured to perform a transform on individual time windows of the input signal to obtain corresponding sound models of the input signal in the individual time windows. A given sound model may be a mathematical representation of harmonics in a given time window of the input signal.

The octave error reduction module may be configured to reduce octave errors in individual time windows. Reducing octave errors may include fitting amplitudes of corresponding harmonics across successive time windows to identify spurious harmonics caused by octave error. Harmonics in the first time window, including the first harmonic and the second harmonic, may be fitted using the corresponding sound model provided by the transform module. The fit may be performed at a plurality of times within the first time window. A determination may be made as to the probabilities of whether the first harmonic and/or the second harmonic are a part of the actual signal or are spurious. The determination may be made based on the quality of the fit of the sound model to the harmonics. The determination may be made based on the pattern and alternation of the harmonics. According to some implementations, pitch probabilities estimated across larger time periods may be computed by compounding the probabilities of the individual pitches in each individual time within the first time window. Continuity of pitch may be used as a prior assumption on the computation of the pitch probabilities.

The formant model module may be configured to model harmonic amplitudes based on a formant model. Generally speaking, a formant may be described as the spectral resonance peaks of the sound spectrum of the voice. One formant model—the source-filter model—postulates that vocalization in humans occurs via an initial periodic signal produced by the glottis (i.e., the source), which is then modulated by resonances in the vocal and nasal cavities (i.e., the filter).

The reconstruction module may be configured to reconstruct the speech component of the input signal with the noise component of the input signal being suppressed. The reconstruction may be performed once each of the parameters of the formant model has been determined. The reconstruction may be performed by interpolating all the time-dependent parameters and then resynthesizing the waveform of the speech component of the input signal.

The output module may be configured to transmit an output signal to a destination. The output signal may include the reconstructed speech component of the input signal.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Octave errors may be reduced during pitch determination for noisy audio signals. Pitch may be tracked over time by determining amplitudes at harmonics for individual time windows of an input signal. Octave errors may be reduced in individual time windows by fitting amplitudes of corresponding harmonics across successive time windows to identify spurious harmonics caused by octave error. A given harmonics in a given time window may be associated with a fitting function that fits amplitudes of harmonics corresponding to the given harmonic in time windows proximate to the given time window. The given harmonic may be identified as either being associated with the same pitch as adjacent harmonics in the given time window or being spurious based on parameters of the fitting function.

Figure 1:
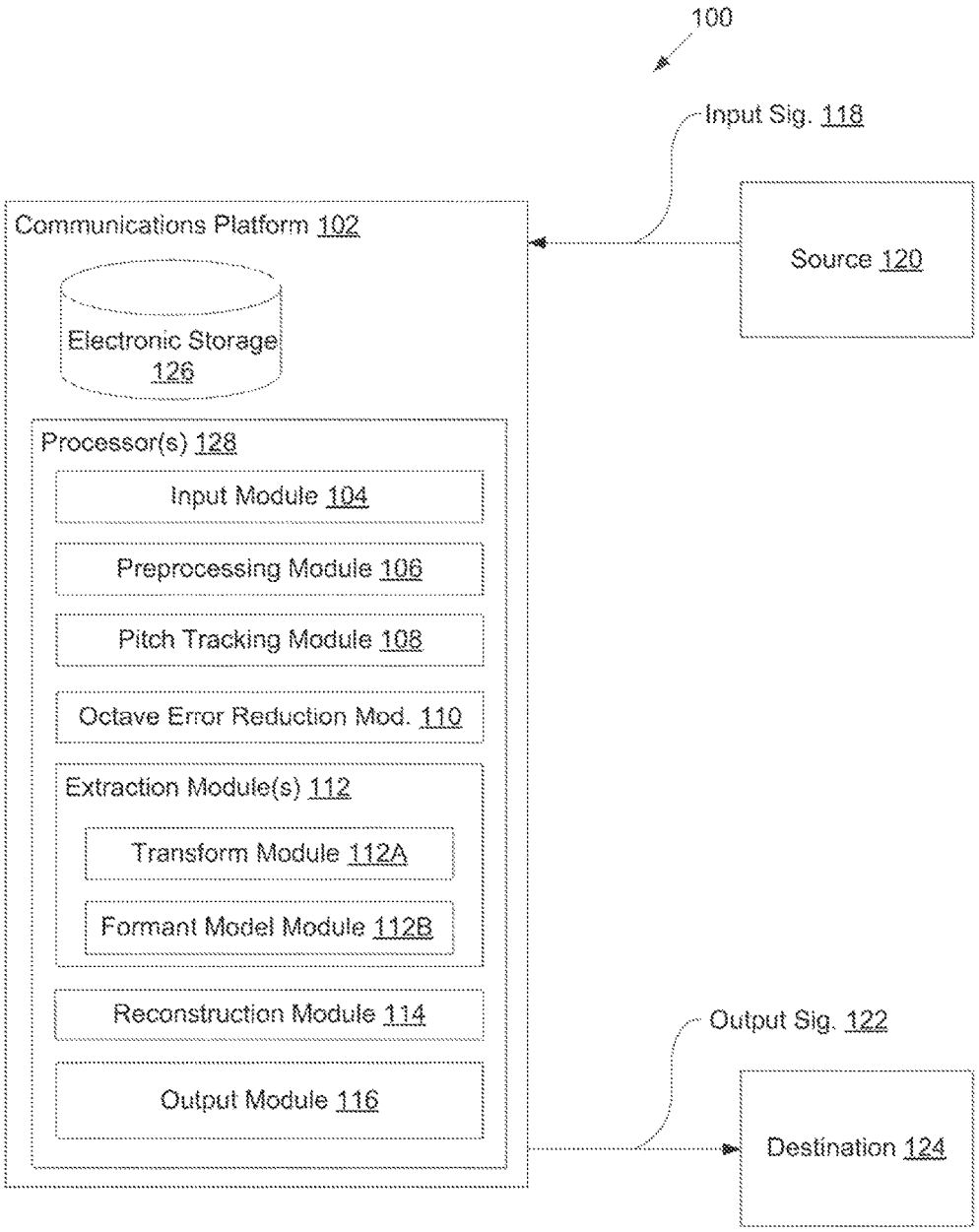
FIG. 1 illustrates a system configured to perform voice enhancement and/or speech feature extraction on noisy audio signals, in accordance with one or more implementations.

FIG. 1 illustrates a system 100 configured to perform voice enhancement and/or speech feature extraction on noisy audio signals, in accordance with one or more implementations. System 100 may be configured to reduce octave errors during pitch determination for such noisy audio signals. Voice enhancement may be also referred to as de-noising or voice cleaning. As depicted in FIG. 1, system 100 may include a communications platform 102 and/or other components. Generally speaking, a noisy audio signal containing speech may be received by communications platform 102. The communications platform 102 may extract harmonic information from the noisy audio signal. The harmonic information may be used to reconstruct speech contained in the noisy audio signal. By way of non-limiting example, communications platform 102 may include a mobile communications device such as a smart phone, according to some implementations. Other types of communications platforms are contemplated by the disclosure, as described further herein.

The communications platform 102 may be configured to execute computer program modules. The computer program modules may include one or more of an input module 104, a preprocessing module 106, one or more extraction modules 112, a reconstruction module 114, an output module 116, and/or other modules.

The input module 104 may be configured to receive an input signal 118 from a source 120. The input signal 118 may include human speech (or some other wanted signal) and noise. The waveforms associated with the speech and noise may be superimposed in input signal 118. The input signal 118 may include a single channel (i.e., mono), two channels (i.e., stereo), and/or multiple channels. The input signal 118 may be digitized.

Speech is the vocal form of human communication. Speech is based upon the syntactic combination of lexicals and names that are drawn from very large vocabularies (usually in the range of about 10,000 different words). Each spoken word is created out of the phonetic combination of a limited set of vowel and consonant speech sound units. Normal speech is produced with pulmonary pressure provided by the lungs which creates phonation in the glottis in the larynx that is then modified by the vocal tract into different vowels and consonants. Various differences among vocabularies, syntax that structures individual vocabularies, sets of speech sound units associated with individual vocabularies, and/or other differences create the existence of many thousands of different types of mutually unintelligible human languages.

The noise included in input signal 118 may include any sound information other than a primary speaker's voice. The noise included in input signal 118 may include structured noise and/or unstructured noise. A classic example of structured noise may be a background scene where there are multiple voices, such as a café or a car environment. Unstructured noise may be described as noise with a broad spectral density distribution. Examples of unstructured noise may include white noise, pink noise, and/or other unstructured noise. White noise is a random signal with a flat power spectral density. Pink noise is a signal with a power spectral density that is inversely proportional to the frequency.

Figure 2:
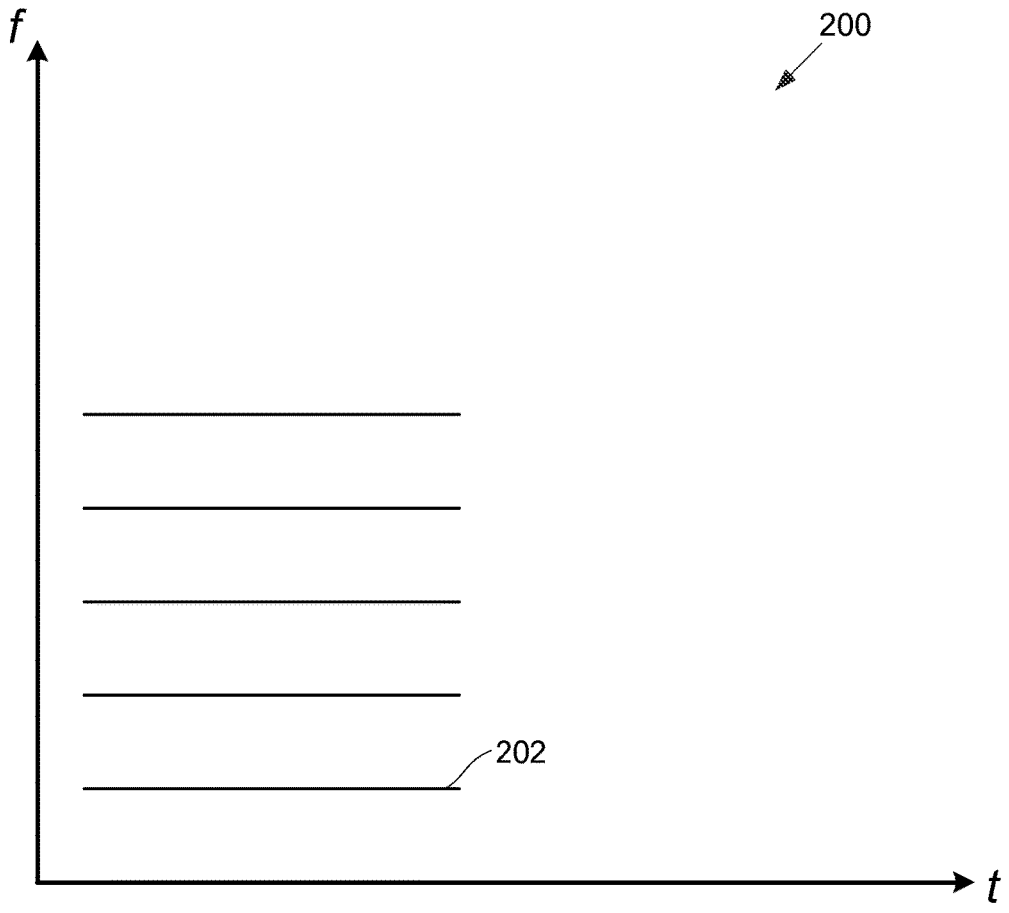
FIG. 2 illustrates an exemplary spectrogram, in accordance with one or more implementations.

An audio signal, such as input signal 118, may be visualized by way of a spectrogram. A spectrogram is a time-varying spectral representation that shows how the spectral density of a signal varies with time. Spectrograms may be referred to as spectral waterfalls, sonograms, voiceprints, and/or voicegrams. Spectrograms may be used to identify phonetic sounds. FIG. 2 illustrates an exemplary spectrogram 200, in accordance with one or more implementations. In spectrogram 200, the horizontal axis represents time (t) and the vertical axis represents frequency (f). A third dimension indicating the amplitude of a particular frequency at a particular time emerges out of the page. A trace of an amplitude peak as a function of time may delineate a harmonic in a signal visualized by a spectrogram (e.g., harmonic 202 in spectrogram 200). In some implementations, amplitude may be represented by the intensity or color of individual points in a spectrogram. In some implementations, a spectrogram may be represented by a 3-dimensional surface plot. The frequency and/or amplitude axes may be either linear or logarithmic, according to various implementations. An audio signal may be represented with a logarithmic amplitude axis (e.g., in decibels, or dB), and a linear frequency axis to emphasize harmonic relationships or a logarithmic frequency axis to emphasize musical, tonal relationships.

Referring again to FIG. 1, source 120 may include a microphone (i.e., an acoustic-to-electric transducer), a remote device, and/or other source of input signal 118. By way of non-limiting illustration, where communications platform 102 is a mobile communications device, a microphone integrated in the mobile communications device may provide input signal 118 by converting sound from a human speaker and/or sound from an environment of communications platform 102 into an electrical signal. As another illustration, input signal 118 may be provided to communications platform 102 from a remote device. The remote device may have its own microphone that converts sound from a human speaker and/or sound from an environment of the remote device. The remote device may be the same as or similar to communications platforms described herein.

The preprocessing module 106 may be configured to segment input signal 118 into discrete successive time windows. According to some implementations, a given time window may have a duration in the range of 30-60 milliseconds. In some implementations, a given time window may have a duration that is shorter than 30 milliseconds or longer than 60 milliseconds. The individual time windows of segmented input signal 118 may have equal durations. In some implementations, the duration of individual time windows of segmented input signal 118 may be different. For example, the duration of a given time window of segmented input signal 118 may be based on the amount and/or complexity of audio information contained in the given time window such that the duration increases responsive to a lack of audio information or a presence of stable audio information (e.g., a constant tone).

Figure 3:
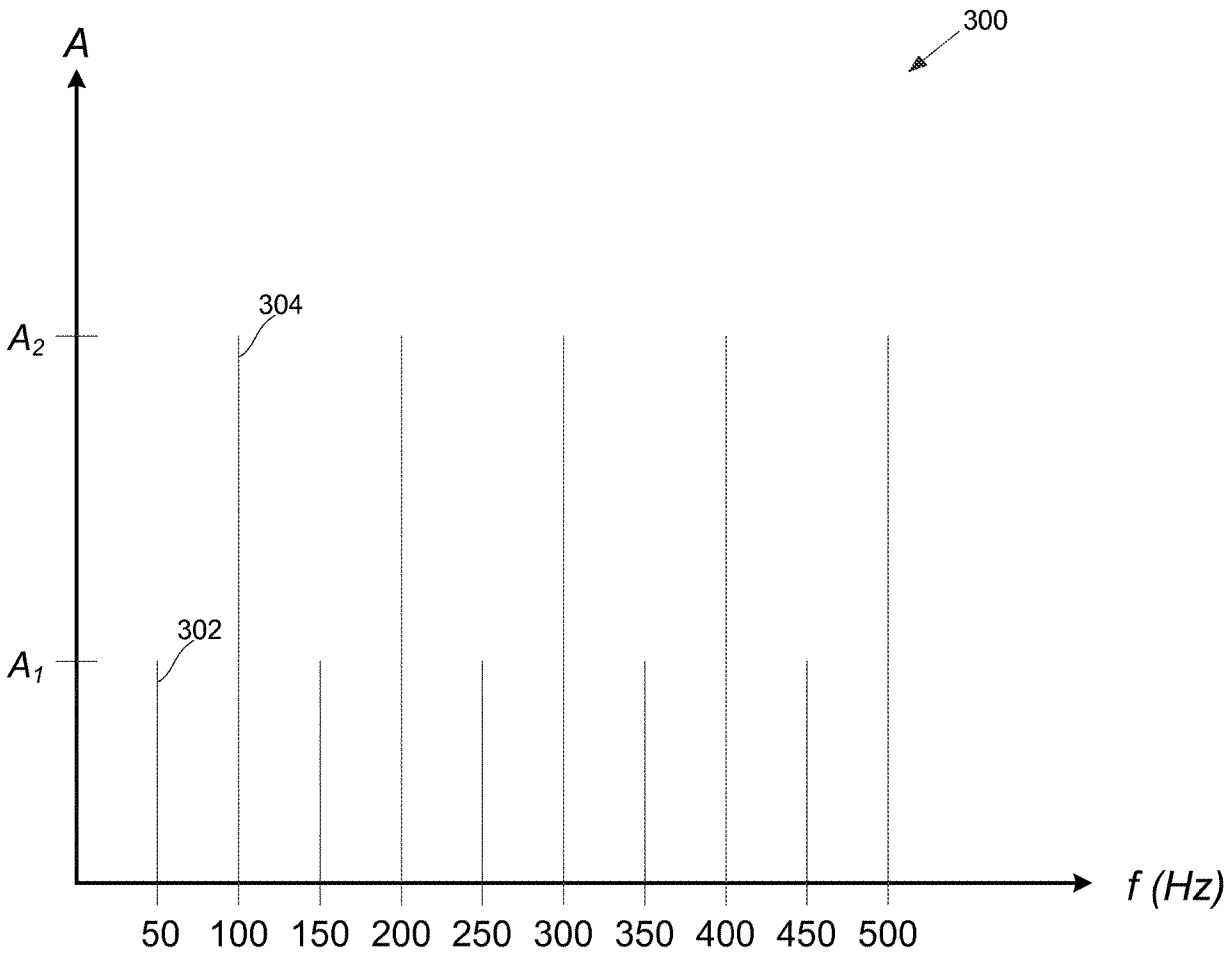
FIG. 3 shows a plot illustrating exemplary amplitudes of harmonics for a given time window, by way of non-limiting illustration.

The pitch tracking module 108 may be configured to track pitch over time. This may include determining amplitudes at harmonics for individual time windows of the input signal. Tracked pitch in a given time window being associated with a first harmonic having a first amplitude, a second harmonic having a second amplitude, and/or other harmonics having corresponding amplitudes. By way of non-limiting illustration, FIG. 3 shows a plot 300 illustrating exemplary amplitudes of harmonics for a given time window. Harmonic 302 has an amplitude $A_1$ at 50 Hz. Harmonic 304 has an amplitude $A_2$ at 100 Hz. While harmonic 302 and harmonic 304 may be adjacent to each other, they may either be associated with the same pitch or different pitches resulting from an octave error. A pitch of 50 Hz will have harmonics that overlaps harmonics of 100 Hz. That is, the harmonics with amplitudes of $A_1$ (e.g., harmonic 302) may have a pitch of 50 Hz so that every other harmonic overlaps the harmonics with amplitudes of $A_2$ (e.g., harmonic 304). Thus, in plot 300, the pitch associated with the given time window could be 50 Hz, or the pitch associated with the given time window could be 100 Hz where the interstitial harmonics (e.g., harmonics at 50 Hz, 150 Hz, 250 Hz, 350 Hz, and/or 450 Hz) are spurious and result from octave error.

The octave error reduction module 110 may be configured to reduce octave errors in individual time windows. The octave error reduction module 110 is described further in conjunction with extraction module(s) 112.

Generally speaking, extraction module(s) 112 may be configured to extract harmonic information from input signal 118. The extraction module(s) 112 may include one or more of a transform module 112A, a formant model module 112B, and/or other modules.

The transform module 112A may be configured to obtain a sound model over individual time windows of input signal 118. In some implementations, transform module 112A may be configured to obtain a linear fit in time of a sound model over individual time windows of input signal 118. A sound model may be described as a mathematical representation of harmonics in an audio signal. A harmonic may be described as a component frequency of the audio signal that is an integer multiple of the fundamental frequency (i.e., the lowest frequency of a periodic waveform or pseudo-periodic waveform). That is, if the fundamental frequency is f, then harmonics have frequencies 2f, 3f, 4f, etc. The harmonics of a given sound model may include a first harmonic and/or a second harmonic depending on whether the first harmonic and/or the second harmonic are identified as either being associated with the same pitch or being spurious based on parameters of the first fitting function and the second fitting function, as discussed in connection with octave error reduction module 110.

The transform module 112A may be configured to model input signal 118 as a superposition of harmonics that all share a common pitch and chirp. Such a model may be expressed as:

$$m(t) = 2\Re\left(\sum_{h=1}^{N_h} A_h e^{j2\pi h(\phi t + \frac{\chi\phi}{2}t^2)}\right), \qquad \text{EQN. 1}$$

where $\phi$ is the base pitch and $\chi$ is the fractional chirp rate $$\left(\chi = \frac{c}{\phi}\right.,$$

where c is the actual chirp), both assumed to be constant. Pitch is defined as the rate of change of phase over time. Chirp is defined as the rate of change of pitch (i.e., the second time derivative of phase). The model of input signal 118 may be assumed as a superposition of $N_h$ harmonics with a linearly varying fundamental frequency. $A_h$ is a complex coefficient weighting all the different harmonics. Being complex, $A_h$ carries information about both the amplitude and about the initial phase for each harmonic.

The model of input signal 118 as a function of $A_h$ may be linear, according to some implementations. In such implementations, linear regression may be used to fit the model, such as follows:

$$\sum_{h=1}^{N_h} A_h e^{j2\pi h(\phi t + \frac{\chi\phi}{2}t^2)} = M(\phi, \chi, t)\overline{A} \qquad \text{EQN. 2}$$

with, discretizing time as $(t_1, t_2, \ldots, t_{N_t})$:

$$M(\phi, \chi) = \begin{bmatrix} e^{j2\pi(\phi t_1 + \frac{\chi\phi}{2}t_1^2)} & e^{j2\pi 2(\phi t_1 + \frac{\chi\phi}{2}t_1^2)} & \ldots & e^{j2\pi N_h(\phi t_1 + \frac{\chi\phi}{2}t_1^2)} \\ e^{j2\pi(\phi t_2 + \frac{\chi\phi}{2}t_2^2)} & e^{j2\pi 2(\phi t_2 + \frac{\chi\phi}{2}t_2^2)} & \ldots & e^{j2\pi N_h(\phi t_2 + \frac{\chi\phi}{2}t_2^2)} \\ \vdots & \vdots & \ddots & \vdots \\ e^{j2\pi(\phi t_{N_t} + \frac{\chi\phi}{2}t_{N_t}^2)} & e^{j2\pi 2(\phi t_{N_t} + \frac{\chi\phi}{2}t_{N_t}^2)} & \ldots & e^{j2\pi N_h(\phi t_{N_t} + \frac{\chi\phi}{2}t_{N_t}^2)} \end{bmatrix}$$

$$\overline{A} = \begin{pmatrix} A_1 \\ \vdots \\ A_{N_h} \end{pmatrix}.$$

The best value for $\overline{A}$ may be solved via standard linear regression in discrete time, as follows:

$$\overline{A} = M(\phi,\chi)\backslash s, \qquad \text{EQN. 3}$$

where the symbol \ represents matrix left division (e.g., linear regression).

Due to input signal 118 being real, the fitted coefficients may be doubled with their complex conjugates as:

$$m(t) = (\,M(\phi, \chi) \quad M^*(\phi, \chi)\,)\begin{pmatrix} \overline{A} \\ \overline{A^*} \end{pmatrix}. \qquad \text{EQN. 5}$$

The optimal values of $\phi,\chi$ may not be determinable via linear regression. A nonlinear optimization step may be performed to determine the optimal values of $\phi,\chi$. Such a nonlinear optimization may include using the residual sum of squares as the optimization metric:

$$[\hat{\phi}, \chi] = \underset{\phi,\chi}{\operatorname{argmin}}\left[\sum_t \left(s(t) - m(t, \phi, \chi, \overline{A})\right)^2\Big|_{\overline{A}=M(\phi,\chi)\backslash s}\right], \qquad \text{EQN. 5}$$

where the minimization is performed on $\phi,\chi$ at the value of $\overline{A}$ given by the linear regression for each value of the parameters being optimized.

The transform module 112A may be configured to impose continuity to different fits over time. That is, both continuity in the pitch estimation and continuity in the coefficients estimation may be imposed to extend the model set forth in EQN. 1. If the pitch becomes a continuous function of time (i.e., $\phi=\phi(t)$), then the chirp may be not needed because the fractional chirp may be determined by the derivative of $\phi(t)$ as $$\chi(t) = \frac{1}{\phi(t)}\frac{d\phi(t)}{dt}.$$

According to some implementations, the model set forth by EQN. 1 may be extended to accommodate a more general time dependent pitch as follows:

$$m(t) = \Re\left(\sum_{h=1}^{N_h} A_h(t)e^{j2\pi h\int_0^t \phi(\tau)d\tau}\right) = \Re\left(\sum_{h=1}^{N_h} A_h(t)e^{jh\Phi(t)}\right), \quad \text{EQN. 6}$$

where $\Phi(t)=2\pi\int_0^t\phi(\tau)d\tau$ is integral phase.

According to model set forth in EQN. 6, the harmonic amplitudes $A_h(t)$ are time dependent. The harmonic amplitudes may be assumed to be piecewise linear in time such that linear regression may be invoked to obtain $A_h(t)$ for a given integral phase $\Phi(t)$:

$$A_h(t) = A_h(0) + \sum_i \Delta A_h^i \sigma\left(\frac{t-t^{i-1}}{t^i-t^{i-1}}\right), \quad \text{EQN. 7}$$

where $$\sigma(t) = \begin{cases} 0 \text{ for } t<0 \\ t \text{ for } 0\le t\le 1 \\ 1 \text{ for } t>1 \end{cases}$$

and $\Delta A_h^i$, are time-dependent harmonic coefficients. The time-dependent harmonic coefficients $\Delta A_h^i$, represent the variation on the complex amplitudes at times $t^i$.

EQN. 7 may be substituted into EQN. 6 to obtain a linear function of the time-dependent harmonic coefficients $\Delta A_h^i$. The time-dependent harmonic coefficients $\Delta A_h^i$ may be solved using standard linear regression for a given integral phase $\Phi(t)$. Actual amplitudes may be reconstructed by $$A_h^i = A_h^0 + \sum_1^i \Delta A_h^i.$$

The linear regression may be determined efficiently due to the fact that the correlation matrix of the model associated with EQN. 6 and EQN. 7 has a block Toeplitz structure, in accordance with some implementations.

A given integral phase $\Phi(t)$ may be optimized via nonlinear regression. Such a nonlinear regression may be performed using a metric similar to EQN. 5. In order to reduce the degrees of freedom, $\Phi(t)$ may be approximated with a number of time points across which to interpolate by $\Phi(t)=\text{interp}(\Phi^1=\Phi(t^1), \Phi^2=\Phi(t^2), \ldots, \Phi^{N_t}=\Phi(t^{N_t}))$. In some implementations, the interpolation function may be cubic. The nonlinear optimization of the integral pitch may be:

$$[\Phi^1, \Phi^{N_t}, \ldots \Phi^{N_t}] = \underset{\Phi^1,\Phi^2,\ldots,\Phi^{N_t}}{\text{argmin}}\left[\sum_t \left(s(t) - m\left(t, \Phi(t), \overline{A_h^i}\right)^2\right)\Bigg|_{\substack{\overline{A_h^i}=M(\Phi(t))\backslash s(t) \\ \Phi(t)=interp(\Phi^1,\Phi^2,\ldots,\Phi^{N_t})}}\right]. \quad \text{EQN. 8}$$

The different $\Phi^i$ may be optimized one at a time with multiple iterations across them. Because each $\Phi^i$ affects the integral phase only around $t^i$, the optimization may be performed locally, according to some implementations.

The octave error reduction module 110 may be configured to reduce octave errors in individual time windows. According to some implementations, reducing octave errors in individual time windows may include fitting amplitudes of corresponding harmonics across successive time windows to identify spurious harmonics caused by octave error. Referring again to plot 300 in FIG. 3, harmonic 302 may be associated with a first sound model that fits amplitudes of harmonics at (or near) integer multiples of 50 Hz in time windows proximate to the time window represented by plot 300. Harmonic 304 may also be associated with a second sound model that fits amplitudes of harmonics at (or near) integer multiples of 100 Hz in time windows proximate to the time window represented by plot 300. Harmonic 302 and/or harmonic 304 may be identified as either being associated with the same pitch or being spurious based on parameters of the sound model confidence and the second sound model confidence. Examples of parameters measuring the confidence of a sound model may include one or more of a coefficient of determination ($R^2$), coefficient of correlation, and/or other parameters. In some implementations, octave error reduction module 110 may be configured to identify a pitch for the time window represented by plot 300 based on non-spurious harmonics within the time window of the input signal. The octave error reduction module 110 may be configured to remove spurious harmonics from individual time windows of the input signal.

Referring now to formant model module 112B in FIG. 1, it may be configured to model harmonic amplitudes based on a formant model. Generally speaking, a formant may be described as the spectral resonance peaks of the sound spectrum of the voice. One formant model—the source-filter model—postulates that vocalization in humans occurs via an initial periodic signal produced by the glottis (i.e., the source), which is then modulated by resonances in the vocal and nasal cavities (i.e., the filter). In some implementations, the harmonic amplitudes may be modeled according to the source-filter model as:

$$A_h(t) = A(t)G(g(t), \omega(t))\left[\prod_{r=1}^{N_f} F(f_r(t), \omega(t))\right]R(\omega(t))\Bigg|_{\omega(t)=\phi(t)h}, \quad \text{EQN. 9}$$

where A(t) is a global amplitude scale common to all the harmonics, but time dependent. G characterizes the source as a function of glottal parameters g(t). Glottal parameters g(t) may be a vector of time dependent parameters. In some implementations, G may be the Fourier transform of the glottal pulse. F describes a resonance (e.g., a formant). The various cavities in a vocal tract may generate a number of resonances F that act in series. Individual formants may be characterized by a complex parameter $f_r(t)$. R represents a parameter-independent filter that accounts for the air impedance.

In some implementations, the individual formant resonances may be approximated as single pole transfer functions:

$$F(f(t), \omega(t)) = \frac{f(t)f(t)^*}{(j\omega(t) - f(t))(j\omega(t) - f(t)^*)}, \quad \text{EQN. 10}$$

where f(t)=jp(t)+d(t) is a complex function, p(t) is the resonance peak p(t), and d(t) is a dumping coefficient. The fitting of one or more of these functions may be discretized in time in a number of parameters $p^i$,$d^i$ corresponding to fitting times $t^i$.

According to some implementations, R may be assumed to be R(t)=1−jω(t), which corresponds to a high pass filter.

The Fourier transform of the glottal pulse G may remain fairly constant over time. In some implementations, G=g(t) g $E(g(t))_t$. The frequency profile of G may be approximated in a nonparametric fashion by interpolating across the harmonics frequencies at different times.

Given the model for the harmonic amplitudes set forth in EQN. 9, the model parameters may be regressed using the sum of squares rule as:

$$[A(t), \hat{g}(t), f_r(t)] = \underset{A(t),g(t),f_r(t)}{\operatorname{argmin}} \left( A_h(t) - A(t)G(g(t), \omega(t)) \left[ \prod_{r=1}^{N_j} F(f_r(t), \omega(t)) \right] R(\omega(t)) \Big|_{\omega(t)=\phi(t)h} \right)^2. \quad \text{EQN. 11}$$

The regression in EQN. 11 may be performed in a nonlinear fashion assuming that the various time dependent functions can be interpolated from a number of discrete points in time. Because the regression in EQN. 11 depends on the estimated pitch, and in turn the estimated pitch depends on the harmonic amplitudes (see, e.g., EQN. 8), it may be possible to iterate between EQN. 11 and EQN. 8 to refine the fit.

In some implementations, the fit of the model parameters may be performed on harmonic amplitudes only, disregarding the phases during the fit. This may make the parameter fitting less sensitive to the phase variation of the real signal and/or the model, and may stabilize the fit. According to one implementation, for example:

$$[A(t), \hat{g}(t), f_r(t)] = \underset{A(t),g(t),f_r(t)}{\operatorname{argmin}} \left( \|A_h(t)\| - \left\| A(t)G(g(t), \omega(t)) \left[ \sum_{r=1}^{N_f} F(f_r(t), \omega(t)) \right] R(\omega(t)) \right\| \Big|_{\omega(t)=\phi(t)h} \right)^2. \quad \text{EQN. 12}$$

In accordance with some implementations, the formant estimation may occur according to:

$$[A(t), f_r(t)] = \underset{A(t),f_r(t)}{\operatorname{argmin}} \left( \sum_h \operatorname{Var}_t \left( \frac{A_h(t)}{A(t) \left[ \prod_{r=1}^{N_f} F(f_r(t), \omega(t)) \right] \Big|_{\omega(t)=\frac{d\Phi}{dt}(t)h}} \right) \right)^2. \quad \text{EQN. 13}$$

EQN. 10 may be extended to include the pitch in one single minimization as:

$$[\Phi(t), A(t), f_r(t)] = \underset{\Phi(t),A(t),f_r(t)}{\operatorname{argmin}} \left( \sum_h \operatorname{Var}_t \left( \frac{s(T) \backslash M(\Phi(t))}{A(t) \left[ \prod_{r=1}^{N_f} F(f_r(t), \omega(t)) \right] \Big|_{\omega(t)=\frac{d\Phi}{dt}(t)h}} \right) \right)^2. \quad \text{EQN. 14}$$

The minimization may occur on a discretized version of the time-dependent parameter, assuming interpolation among the different time samples of each of them.

The final residual of the fit on the HAM($A_h$(t)) for both EQN. 10 and EQN. 11 may be assumed to be the glottal pulse. The glottal pulse may be subject to smoothing (or assumed constant) by taking an average:

$$G(\omega) = E_t(G(\omega, t)) = E_t \left( \frac{A_h(t)}{A(t) \left[ \prod_{r=1}^{N_f} F(f_r(t), \omega) \right] \Big|_{\omega(t)=\frac{d\Phi}{dt}(t)h}} \right). \quad \text{EQN. 15}$$

The reconstruction module 114 may be configured to reconstruct the speech component of input signal 118 with the noise component of input signal 118 being suppressed. The reconstruction may be performed once each of the parameters of the formant model has been determined. The reconstruction may be performed by interpolating all the time-dependent parameters and then resynthesizing the waveform of the speech component of input signal 118 according to:

$$\hat{s}(t) = 2\Re \left( \sum_{h=1}^{N_h} A(t)G(\omega) \left[ \prod_{r=1}^{N_f} F(f_r(t), \omega(t)) \right] R(\omega(t)) \Big|_{\omega(t)=\frac{d\Phi(t)}{dt}h} e^{j\Phi(t)} \right). \quad \text{EQN. 16}$$

The output module 116 may be configured to transmit an output signal 122 to a destination 124. The output signal 122 may include the reconstructed speech component of input signal 118, as determined by EQN. 13. The destination 124 may include a speaker (i.e., an electric-to-acoustic transducer), a remote device, and/or other destination for output signal 122. By way of non-limiting illustration, where communications platform 102 is a mobile communications device, a speaker integrated in the mobile communications device may provide output signal 122 by converting output signal 122 to sound to be heard by a user. As another illustration, output signal 122 may be provided from communications platform 102 to a remote device. The remote device may have its own speaker that converts output signal 122 to sound to be heard by a user of the remote device.

In some implementations, one or more components of system 100 may be operatively linked via one or more electronic communication links. For example, such electronic communication links may be established, at least in part, via a network such as the Internet, a telecommunications network, and/or other networks. It will be appreciated that this is not intended to be limiting, and that the scope of this disclosure includes implementations in which one or more components of system 100 may be operatively linked via some other communication media.

The communications platform 102 may include electronic storage 126, one or more processors 128, and/or other components. The communications platform 102 may include communication lines, or ports to enable the exchange of information with a network and/or other platforms. Illustration of communications platform 102 in FIG. 1 is not intended to be limiting. The communications platform 102 may include a plurality of hardware, software, and/or firmware components operating together to provide the functionality attributed herein to communications platform 102. For example, communications platform 102 may be implemented by two or more communications platforms operating together as communications platform 102. By way of non-limiting example, communications platform 102 may include one or more of a server, desktop computer, a laptop computer, a handheld computer, a NetBook, a Smartphone, a cellular phone, a telephony headset, a gaming console, and/or other communications platforms.

The electronic storage 126 may comprise electronic storage media that electronically stores information. The electronic storage media of electronic storage 126 may include one or both of system storage that is provided integrally (i.e., substantially non-removable) with communications platform 102 and/or removable storage that is removably connectable to communications platform 102 via, for example, a port (e.g., a USB port, a firewire port, etc.) or a drive (e.g., a disk drive, etc.). The electronic storage 126 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage 126 may include one or more virtual storage resources (e.g., cloud storage, a virtual private network, and/or other virtual storage resources). The electronic storage 126 may store software algorithms, information determined by processor (s) 128, information received from a remote device, information received from source 120, information to be transmitted to destination 124, and/or other information that enables communications platform 102 to function as described herein.

The processor(s) 128 may be configured to provide information processing capabilities in communications platform 102. As such, processor(s) 128 may include one or more of a digital processor, an analog processor, a digital circuit designed to process information, an analog circuit designed to process information, a state machine, and/or other mechanisms for electronically processing information. Although processor(s) 128 is shown in FIG. 1 as a single entity, this is for illustrative purposes only. In some implementations, processor(s) 128 may include a plurality of processing units. These processing units may be physically located within the same device, or processor(s) 128 may represent processing functionality of a plurality of devices operating in coordination. The processor(s) 128 may be configured to execute modules 104, 106, 108, 110, 112A, 112B, 114, 116, and/or other modules. The processor(s) 128 may be configured to execute modules 104, 106, 108, 110, 112A, 112B, 114, 116, and/or other modules by software; hardware; firmware; some combination of software, hardware, and/or firmware; and/or other mechanisms for configuring processing capabilities on processor(s) 128.

It should be appreciated that although modules 104, 106, 108, 110, 112A, 112B, 114, and 116 are illustrated in FIG. 1 as being co-located within a single processing unit, in implementations in which processor(s) 128 includes multiple processing units, one or more of modules 104, 106, 108, 110, 112A, 112B, 114, and/or 116 may be located remotely from the other modules. The description of the functionality provided by the different modules 104, 106, 108, 110, 112A, 112B, 114, and/or 116 described below is for illustrative purposes, and is not intended to be limiting, as any of modules 104, 106, 108, 110, 112A, 112B, 114, and/or 116 may provide more or less functionality than is described. For example, one or more of modules 104, 106, 108, 110, 112A, 112B, 114, and/or 116 may be eliminated, and some or all of its functionality may be provided by other ones of modules 104, 106, 108, 110, 112A, 112B, 114, and/or 116. As another example, processor(s) 128 may be configured to execute one or more additional modules that may perform some or all of the functionality attributed below to one of modules 104, 106, 108, 110, 112A, 112B, 114, and/or 116.

Figure 4:
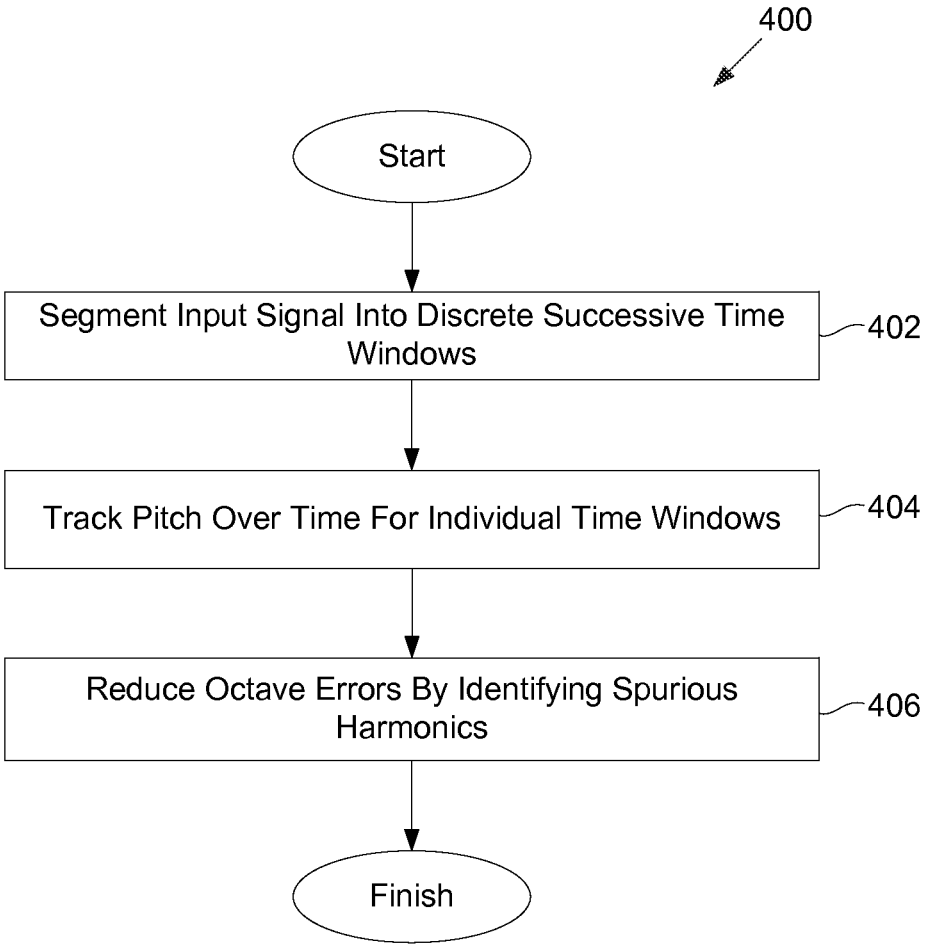
FIG. 4 illustrates a method for reducing octave errors during pitch determination for noisy audio signals, in accordance with one or more implementations.

FIG. 4 illustrates a method 400 for reducing octave errors during pitch determination for noisy audio signals, in accordance with one or more implementations. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

In some embodiments, method 400 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 400 in response to instructions stored electronically on an electronic storage medium. The one or more processing devices may include one or more devices configured through hardware, firmware, and/or software to be specifically designed for execution of one or more of the operations of method 400.

At an operation 402, an input signal may be segmented into discrete successive time windows. The input signal may convey audio comprising a speech component superimposed on a noise component. The time windows may include a first time window. Operation 402 may be performed by one or more processors configured to execute a preprocessing module that is the same as or similar to preprocessing module 106, in accordance with one or more implementations.

At an operation 404, pitch may be tracked over time by determining amplitudes at harmonics for individual time windows of the input signal. Tracked pitch in the first time window may be associated with a first harmonic having a first amplitude and a second harmonic having a second amplitude. The first harmonic and the second harmonic may be adjacent but either associated with the same pitch or different pitches resulting from an octave error. Operation 404 may be performed by one or more processors configured to execute a pitch tracking module that is the same as or similar to pitch tracking module 108, in accordance with one or more implementations.

At an operation 406, octave errors may be reduced in individual time windows by fitting amplitudes of corresponding harmonics across successive time windows to identify spurious harmonics caused by octave error. Operation 406 may be performed by one or more processors configured to execute an octave error reduction module that is the same as or similar to octave error reduction module 110, in accordance with one or more implementations.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for processing audio signals, comprising:

one or more processors configured to execute one or more computer program modules configured to:

receive an input signal from a source;

segment the input signal into discrete successive time windows, the input signal comprising a speech component superimposed on a noise component;

perform a transform on individual time windows of the input signal to obtain frequency spectrum of the input signal in a frequency domain;

perform pitch tracking across multiple time windows to determine amplitudes corresponding to harmonics of a first fundamental frequency and amplitudes corresponding to harmonics of a second fundamental frequency;

fit the amplitudes corresponding to the harmonics of the first fundamental frequency across the successive time windows to a first sound model, wherein the first sound model is represented in a first superposition of a first set of harmonics of the first fundamental frequency with the first fundamental frequency linearly varying across the successive time windows;

fit the amplitudes corresponding to the harmonics of the second fundamental frequency across the successive time windows to a second sound model, wherein the second sound model is represented in a second superposition of a second set of harmonics of the second fundamental frequency with the second fundamental frequency linearly varying across the successive time windows;

determine whether the harmonics of the first fundamental frequency or the harmonics of the second fundamental frequency are spurious based on parameters of sound model confidence;

remove the harmonics of the first fundamental frequency or the harmonics of the second fundamental frequency determined to be spurious from the input signal;

generate an output signal by reconstructing speech component of the input signal with the harmonics of the first fundamental frequency or the harmonics of the second fundamental frequency determined to be spurious removed; and convert the output signal to sound to be heard by a user.

2. The system of claim 1, wherein the one or more computer modules are further configured to identify a common pitch of non-spurious harmonics within the first time window of the input signal.

3. The system of claim 1, wherein to fit the amplitudes corresponding to the harmonics of the first fundamental frequency to the first sound model and to fit the amplitudes corresponding to the harmonics of the second fundamental frequency to the second sound model include to apply one or more of a polynomial regression, nonlinear regression, or Poisson regression.

4. The system of claim 1, wherein the parameters of sound model confidence include one or more of a coefficient of determination or coefficient of correlation.

5. The system of claim 1, wherein the system comprises a mobile communication device, the source is a microphone integrated in the mobile communications device and the output signal is converted to the sound by a speaker of the mobile communication device.

6. The system of claim 1, wherein to fit the amplitudes corresponding to the harmonics of the first fundamental frequency to the first sound model and to fit the amplitudes corresponding to the harmonics of the second fundamental frequency to the second sound model include applying a formant model that is based at least in part on human vocal and nasal cavities.

7. The system of claim 6, wherein to fit the amplitudes corresponding to the harmonics of the first fundamental frequency to the first sound model and to fit the amplitudes corresponding to the harmonics of the second fundamental frequency to the second sound model each includes:

applying a first nonlinear regression when fitting the amplitudes of a respective harmonic to the respective sound model to obtain an estimated pitch for the respective harmonic and applying a second nonlinear regression on the formant model to obtain model parameters of the formant model; and iterating between the first nonlinear regression and second nonlinear regression to refine the fittings.

8. A processor-implemented method for processing audio signals, the method comprising:

receiving an input signal from a source;

segmenting the input signal into discrete successive time windows, the input signal comprising a speech component superimposed on a noise component;

performing a transform on individual time windows of the input signal to obtain frequency spectrum of the input signal in a frequency domain;

performing pitch tracking across multiple time windows to determine amplitudes corresponding to harmonics of a first fundamental frequency and amplitudes corresponding to harmonics of a second fundamental frequency;

fitting the amplitudes corresponding to the harmonics of the first fundamental frequency across the successive time windows to a first sound model, wherein the first sound model is represented in a first superposition of a first set of harmonics of the first fundamental frequency with the first fundamental frequency linearly varying across the successive time windows;

fitting the amplitudes corresponding to the harmonics of the second fundamental frequency across the successive time windows to a second sound model, wherein the second sound model is represented in a second superposition of a second set of harmonics of the second fundamental frequency with the second fundamental frequency linearly varying across the successive time windows; and determining whether the harmonics of the first fundamental frequency or the harmonics of the second fundamental frequency are spurious based on parameters of sound model confidence;

removing the harmonics of the first fundamental frequency or the harmonics of the second fundamental frequency determined to be spurious from the input signal;

generating an output signal by reconstructing speech component of the input signal with the harmonics of the first fundamental frequency or the harmonics of the second fundamental frequency determined to be spurious removed; and converting the output signal to sound using an output device.

9. The method of claim 8, further comprising identifying a common pitch of non-spurious harmonics within the first time window of the input signal.

10. The method of claim 8, wherein fitting the amplitudes corresponding to the harmonics of the first fundamental frequency to the first sound model and fitting the amplitudes corresponding to the harmonics of the second fundamental frequency to the second sound model include applying one or more of a polynomial regression, nonlinear regression, or Poisson regression.

11. The method of claim 8, wherein the parameters of sound model confidence include one or more of a coefficient of determination or coefficient of correlation.

12. The method of claim 8, further comprising applying, to fit the amplitudes corresponding to the harmonics of the first fundamental frequency to the first sound model and to fit the amplitudes corresponding to the harmonics of the second fundamental frequency to the second sound model, respectively, a formant model that is based at least in part on human vocal and nasal cavities.

13. The method of claim 12, wherein applying the formant model includes:

applying a first nonlinear regression when fitting the amplitudes of a respective harmonic to the respective sound model to obtain an estimated pitch for the respective harmonic and applying a second nonlinear regression on the formant model to obtain model parameters of the formant model; and iterating between the first nonlinear regression and second nonlinear regression to refine the fittings.

14. One or more non-transitory computer readable storage media encoded with software comprising computer executable instructions and when the software is executed operable to:

receive an input signal from a source;

segment the input signal into discrete successive time windows, the input signal comprising a speech component superimposed on a noise component, the time windows;

perform a transform on individual time windows of the input signal to obtain frequency spectrum of the input signal in a frequency domain;

perform pitch tracking across multiple time windows to determine amplitudes corresponding to harmonics of a first fundamental frequency and amplitudes corresponding to harmonics of a second fundamental frequency;

fit the amplitudes corresponding to the harmonics of the first fundamental frequency across the successive time windows to a first sound model, wherein the first sound model is represented in a first superposition of a first set of harmonics of the first fundamental frequency with the first fundamental frequency linearly varying across the successive time windows;

fit the amplitudes corresponding to the harmonics of the second fundamental frequency across the successive time windows to a second sound model, wherein the second sound model is represented in a second superposition of a second set of harmonics of the second fundamental frequency with the second fundamental frequency linearly varying across the successive time windows;

determine whether the harmonics of the first fundamental frequency or the harmonics of the second fundamental frequency are spurious based on parameters of sound model confidence;

remove the harmonics of the first fundamental frequency or the harmonics of the second fundamental frequency determined to be spurious from the input signal;

generate an output signal by reconstructing speech component of the input signal with the harmonics of the first fundamental frequency or the harmonics of the second fundamental frequency determined to be spurious removed; and convert the output signal to sound using an output device.

15. The non-transitory computer readable storage media of claim 14, further comprising computer executable instructions operable to identify a common pitch of non-spurious harmonics within the first time window of the input signal.

16. The non-transitory computer readable storage media of claim 14, wherein to fit the amplitudes corresponding to the harmonics of the first fundamental frequency to the first sound model and to fit the amplitudes corresponding to the harmonics of the second fundamental frequency to the second sound model include to apply one or more of a polynomial regression, nonlinear regression, or Poisson regression.

17. The non-transitory computer readable storage media of claim 14, wherein the parameters of sound model confidence include one or more of a coefficient of determination or coefficient of correlation.

18. The non-transitory computer readable storage media of claim 14, wherein to fit the amplitudes corresponding to the harmonics of the first fundamental frequency to the first sound model and to fit the amplitudes corresponding to the harmonics of the second fundamental frequency to the second sound model include applying a formant model that is based at least in part on human vocal and nasal cavities.

19. The non-transitory computer readable storage media of claim 18, wherein to fit the amplitudes corresponding to the harmonics of the first fundamental frequency to the first sound model and to fit the amplitudes corresponding to the harmonics of the second fundamental frequency to the second sound model each includes:

applying a first nonlinear regression when fitting the amplitudes of a respective harmonic to the respective sound model to obtain an estimated pitch for the respective harmonic and applying a second nonlinear regression on the formant model to obtain model parameters of the formant model; and iterating between the first nonlinear regression and second nonlinear regression to refine the fittings.

* * * * *